US010822757B2

(12) United States Patent
Pavey

(10) Patent No.: US 10,822,757 B2
(45) Date of Patent: Nov. 3, 2020

(54) SHOVEL WITH REMOVABLE HANDLE

(71) Applicant: Robert Thomas Pavey, Mahtomedi, MN (US)

(72) Inventor: Robert Thomas Pavey, Mahtomedi, MN (US)

( * ) Notice: Subject to any disclaimer, the term of this patent is extended or adjusted under 35 U.S.C. 154(b) by 36 days.

(21) Appl. No.: 16/176,014

(22) Filed: Oct. 31, 2018

(65) Prior Publication Data

US 2020/0131726 A1 Apr. 30, 2020

(51) Int. Cl.
*E01H 5/02* (2006.01)
*E01H 5/06* (2006.01)

(52) U.S. Cl.
CPC ..... *E01H 5/02* (2013.01); *E01H 5/061* (2013.01)

(58) Field of Classification Search
CPC ..... B25G 1/04; B25G 3/26; B25B 23/0021; A01D 7/08
USPC ..... 37/284; 172/370, 371, 375
See application file for complete search history.

(56) References Cited

U.S. PATENT DOCUMENTS 841,848 A 1/1907 Conner
2,463,150 A 3/1949 Camp
2,484,409 A * 10/1949 Jameson ..... A01B 1/028 294/59
D187,874 S * 5/1960 Cross ..... D15/11
3,078,604 A * 2/1963 Neuman ..... E01H 5/02 294/54.5
4,199,181 A 4/1980 Mason
4,559,726 A * 12/1985 Moisan ..... E01H 5/02 294/51
4,597,204 A 7/1986 Heiden
RE32,948 E 6/1989 Lapshansky
D319,757 S 9/1991 Nelson
D361,482 S 8/1995 Fugal
5,440,828 A 8/1995 Simpson
5,669,163 A * 9/1997 Winter ..... E01H 5/02 37/265
5,676,412 A 10/1997 Kahley
D392,522 S 3/1998 Kenyon
5,829,808 A 11/1998 Colla
5,871,246 A * 2/1999 Simdom ..... A01B 1/026 294/54.5
5,975,602 A 11/1999 Zan
6,053,548 A 4/2000 Bowles, Jr.
6,746,062 B2 * 6/2004 Bielecki et al. ..... A47J 43/288 16/422
7,156,435 B1 1/2007 Mourelatos
(Continued)

FOREIGN PATENT DOCUMENTS

GB 2063142 6/1981
WO WO 95/02732 1/1995

*Primary Examiner* — Tara Mayo-Pinnock
(74) *Attorney, Agent, or Firm* — Fredrikson & Byron, P.A.

(57) ABSTRACT

The present disclosure provides a shovel including a blade, at least one fastener, a connector, and a handle. The blade has a first major surface and an opposing second major surface, and each of the fastener(s) and the connector are attached to the second major surface. The handle is removably attached to the connector. In use, such as for use as a snow shovel, the handle is attached to the connector. Advantageously, when the shovel is not in use, the handle may be removed from the connector and attached to and held by the fastener(s), which decreases the overall dimensions of the shovel for ease of storage and/or transport.

16 Claims, 8 Drawing Sheets

(56) References Cited

U.S. PATENT DOCUMENTS

| | | | | |
|---|---|---|---|---|
| 7,305,779 | B1 | 12/2007 | Purvis | |
| D703,013 | S | 4/2014 | Firth | |
| 2007/0013198 | A1 | 1/2007 | Brazeau | |
| 2007/0108783 | A1 | 5/2007 | Petruzelli | |
| 2009/0051180 | A1 | 2/2009 | Marlin | |
| 2011/0001326 | A1 | 1/2011 | Towles | |
| 2014/0137338 | A1* | 5/2014 | Meinzer et al. ..... | B25F 1/02 7/116 |

* cited by examiner

SHOVEL WITH REMOVABLE HANDLE

TECHNICAL FIELD

The present disclosure relates to shovels, and more particularly to shovels having adaptable configurations.

BACKGROUND

A persistent issue for residential properties is removal of snowfall from driveways and sidewalks during cold weather. Numerous shovel designs are available for lifting and pushing snow. However, snow shovels can be quite large and take up a lot of room in a garage or other storage area. Likewise, the large size of many shovels can make it difficult to put a snow shovel in a vehicle trunk to bring home at the time of purchase or to take to another property for use. Only a few designs allow for decreasing the size of a shovel, for instance by the inclusion of a telescoping or foldable handle.

Consequently, there remains a need for further developments in shovel configurations.

SUMMARY

The present disclosure provides adaptable shovels, for example snow shovels.

In an aspect, a shovel is provided. The shovel includes a blade, at least one fastener, a connector, and a handle. The blade has a first major surface and an opposing second major surface, and each of the fastener(s) and the connector are attached to the second major surface. The handle is removably attached to the connector.

Various unexpected results and advantages are obtained in exemplary embodiments of the disclosure. One such advantage of exemplary embodiments of the present disclosure is the ability to change the configuration of the shovel. In use, such as for use pushing or lifting snow, the handle is attached to the connector. When the shovel is not in use, however, the handle may be removed from the connector and attached to and held by the fastener(s). This advantageously decreases the overall dimensions of the shovel for ease of storage and/or transport and keeps the handle and the blade fastened together. Another advantage of certain exemplary embodiments of the present disclosure is the ability to windrow (e.g., push) snow instead of lifting snow when shoveling, and an angled blade can minimize catching of the blade on seams in a driveway or sidewalk.

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the cited list serves only as a representative group and should not be interpreted as an exclusive list.

Figure 1A:
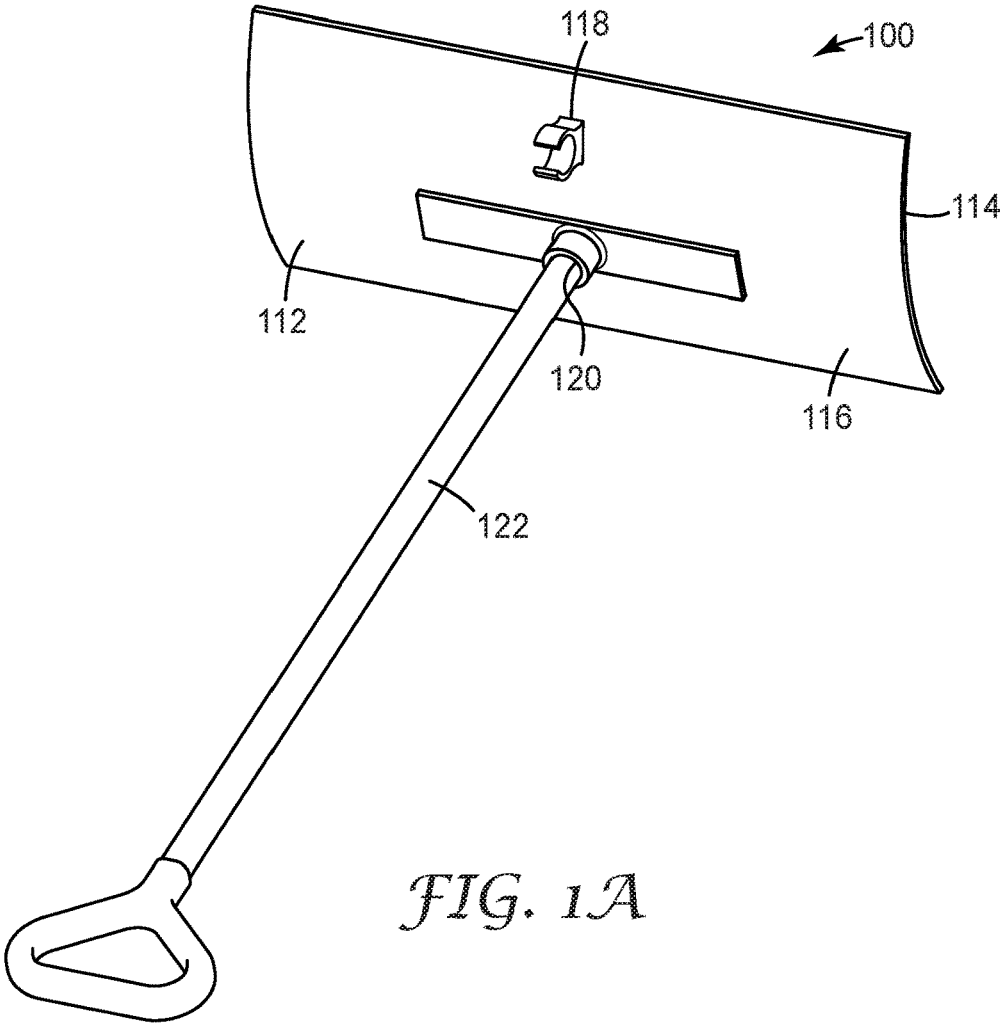
FIG. 1A is a perspective schematic including a shovel according to an exemplary embodiment, in a position for use.

While the above-identified figures set forth several embodiments of the disclosure other embodiments are also contemplated, as noted in the description. The figures are not necessarily drawn to scale. In all cases, this disclosure presents the invention by way of representation and not limitation. It should be understood that numerous other modifications and embodiments can be devised by those skilled in the art, which fall within the scope and spirit of the principles of the present disclosure.

DETAILED DESCRIPTION

Shovels with removable handles are provided that are detachable and re-attachable when desired, for taking up less space than when attached or for use, respectively. There is a need for more adaptable shovel configurations for a user's convenience.

For the following Glossary of defined terms, these definitions shall be applied for the entire application, unless a different definition is provided in the claims or elsewhere in the specification.

Glossary

Certain terms are used throughout the description and the claims that, while for the most part are well known, may require some explanation. It should be understood that, as used herein:

As used in this specification and the appended embodiments, the singular forms "a", "an", and "the" include plural referents unless the content clearly dictates otherwise. Thus, for example, reference to "a material" includes a mixture of two or more materials.

As used in this specification and the appended embodiments, the term "or" is generally employed in its sense including "and/or" unless the content clearly dictates otherwise. The term "and/or" means either or both. For example, the expression "A and/or B" means A, B, or a combination of A and B.

As used in this specification, the recitation of numerical ranges by endpoints includes all numbers subsumed within that range (e.g. 1 to 5 includes 1, 1.5, 2, 2.75, 3, 3.8, 4, and 5).

Unless otherwise indicated, all numbers expressing quantities, measurement of properties, and so forth used in the specification and embodiments are to be understood as being modified in all instances by the term "about." Accordingly, unless indicated to the contrary, the numerical parameters set forth in the foregoing specification and attached listing of embodiments can vary depending upon the desired properties sought to be obtained by those skilled in the art utilizing the teachings of the present disclosure. At the very least, and not as an attempt to limit the application of the doctrine of equivalents to the scope of the claimed embodiments, each numerical parameter should at least be construed in light of the number of reported significant digits and by applying ordinary rounding techniques.

The term "comprises" and variations thereof do not have a limiting meaning where these terms appear in the description and claims.

The words "preferred" and "preferably" refer to embodiments of the disclosure that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure.

The term "windrow" refers to pushing snow with a shovel such that it is transferred to an area adjacent to one side of the shovel.

As used herein, the term "connector" refers to a device that attaches a shovel handle to a shovel blade for use.

As used herein, the term "fastener" refers to a device that attaches a shovel handle to a surface of a shovel blade for storage or transportation.

The term "integral" refers to being composed of parts that together constitute a whole, made at the same time or incapable of being separated without damaging one or more of the (integral) parts.

Reference throughout this specification to "one embodiment," "certain embodiments," "one or more embodiments" or "an embodiment," whether or not including the term "exemplary" preceding the term "embodiment," means that a particular feature, structure, material, or characteristic described in connection with the embodiment is included in at least one embodiment of the certain exemplary embodiments of the present disclosure. Thus, the appearances of the phrases such as "in one or more embodiments," "in certain embodiments," "in one embodiment," "in many embodiments" or "in an embodiment" in various places throughout this specification are not necessarily referring to the same embodiment of the certain exemplary embodiments of the present disclosure. Furthermore, the particular features, structures, materials, or characteristics may be combined in any suitable manner in one or more embodiments.

Various exemplary embodiments of the disclosure will now be described. Exemplary embodiments of the present disclosure may take on various modifications and alterations without departing from the spirit and scope of the disclosure. Accordingly, it is to be understood that the embodiments of the present disclosure are not to be limited to the following described exemplary embodiments, but are to be controlled by the limitations set forth in the claims and any equivalents thereof.

In an aspect, a shovel is provided comprising:

a) a blade comprising a first major surface and an opposing second major surface;

b) at least one fastener attached to the second major surface of the blade;

c) a connector attached to the second major surface of the blade; and d) a handle removably attached to the connector.

Referring to FIG. 1A, a perspective schematic view is provided of a shovel 100 comprising a) a blade 112 comprising a first major surface 114 and an opposing second major surface 116; b) at least one fastener 118 attached to the second major surface 116; c) a connector 120 attached to the second major surface of the blade; and d) a handle 122 removably attached to the connector. The blade may be made of any material suitable for shovels, such as metal (e.g., aluminum or steel) or plastic. In some embodiments, the blade is formed of plastic. Suitable plastics include for instance and without limitation, polyester, nylon, polyethylene (e.g., high density polyethylene or ultra-high molecular weight polyethylene), polypropylene, and polystyrene.

The number of fasteners disposed on the blade is not particularly limited and may be selected to hold a handle or two or more handle sections of a handle having a plurality of separable segments. In many embodiments, the at least one fastener comprises two to four fasteners, such as two fasteners, three fasteners, or four fasteners.

Figure 1B:
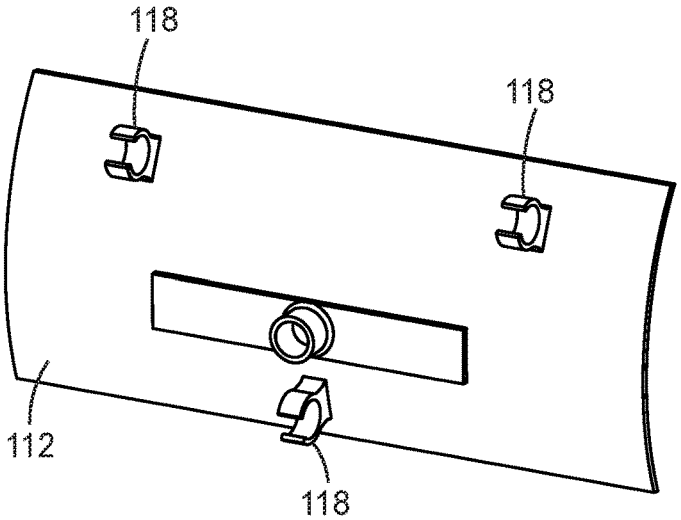
FIG. 1B is a perspective schematic including a blade according to an exemplary embodiment.

Referring to FIG. 1B, a blade 112 comprises three fasteners 118. The inclusion of three fasteners may be useful when the handle is detachable into two pieces, wherein one piece is shorter in length than the other. For instance, the shorter piece may be held to the blade by a single fastener, while the longer piece may be held to the blade by two fasteners separated from each other by a predetermined distance. For simplicity, each fastener is drawn the same, but any type of fastener and/or more than one type of fastener used on a single blade is contemplated.

Figure 2A:
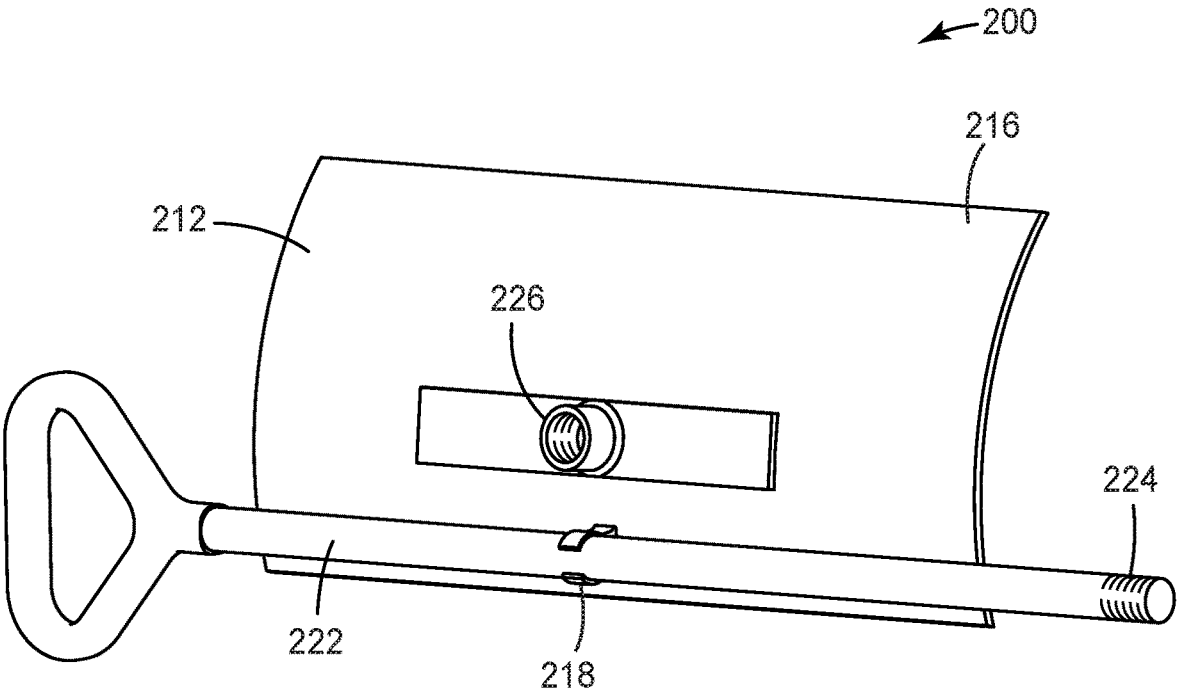
FIG. 2A is a perspective schematic including a shovel according to an exemplary embodiment, in a position for storage or transport.
Figure 2B:
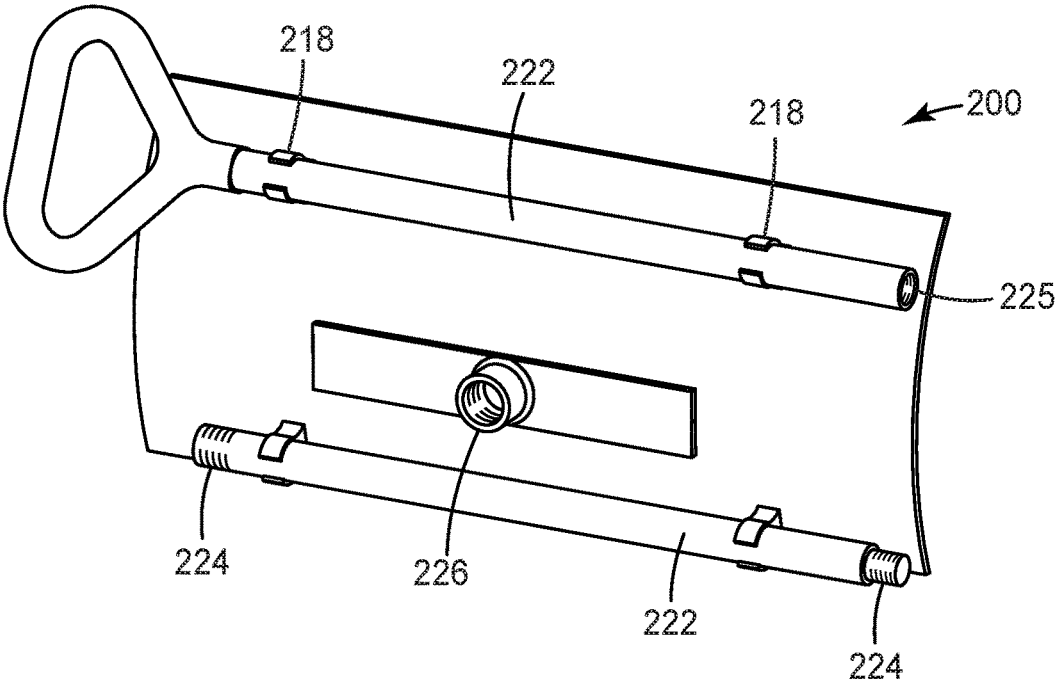
FIG. 2B is a perspective schematic including a shovel according to another exemplary embodiment, in a position for storage or transport.
Figure 2C:
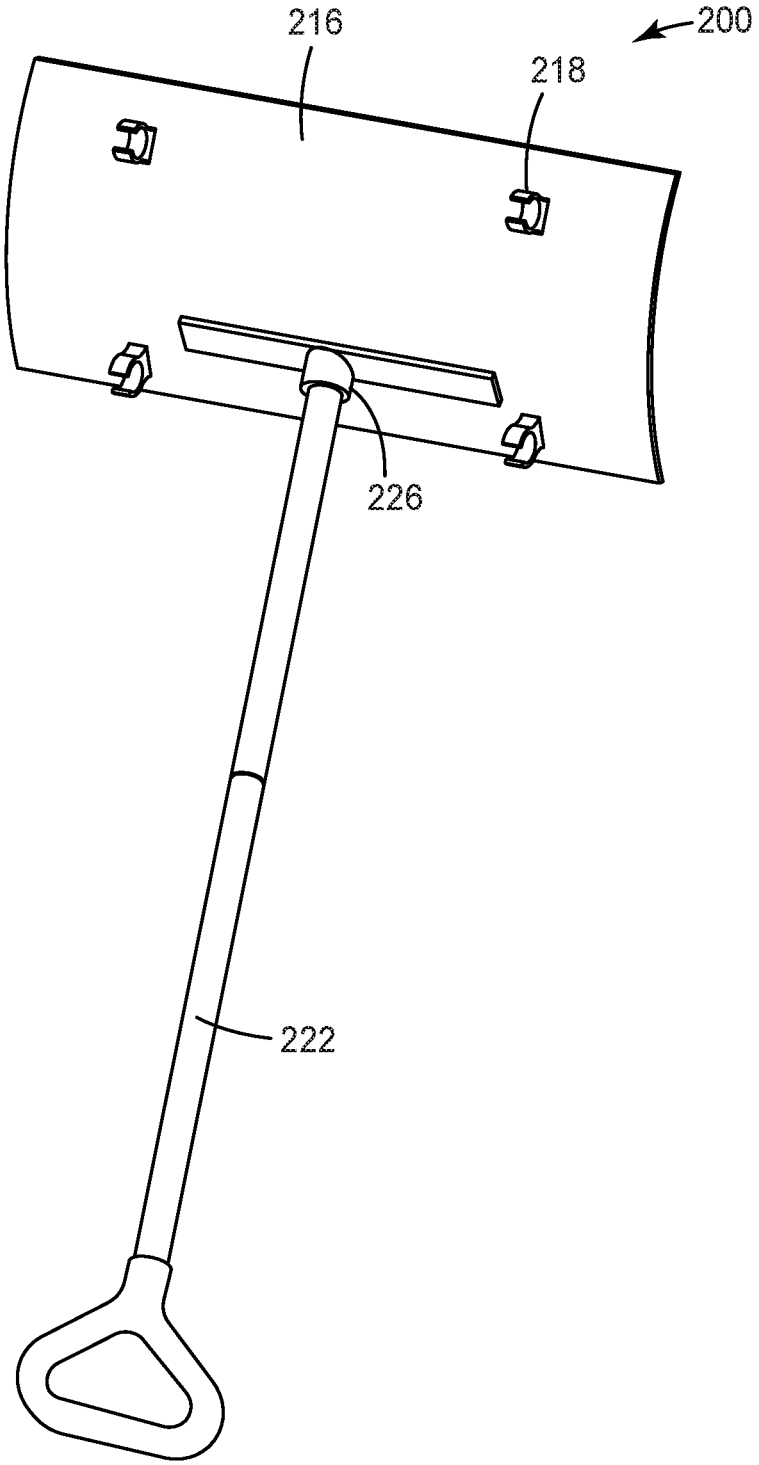
FIG. 2C is a perspective schematic including a shovel according to FIG. 2B, in a position for use.

Referring to FIG. 2A, a shovel 200 is shown in which the at least one fastener 218 on the second major surface 216 of the blade 212 is configured to removably receive and hold the handle 222. Similarly, referring to FIG. 2B, the at least one fastener 218 comprises four fasteners 218 configured to removably receive and hold two detachable pieces of a handle 222. In the embodiment shown in FIG. 2B, the two pieces of the handle 222 comprise threaded connectors 224 or 225, both to attach to each other and to attach to the connector 226. One end of a piece of the handle 222 comprises a female thread 225, as does the connector 226, while both ends of a piece of the handle 222 comprise male threads 224. Other arrangements of threaded connectors are also contemplated for alternate embodiments. Referring to FIG. 2C, a shovel 200 is configured in a position for use, with the handle 222 attached to the second major surface 216 of the blade by the connector 226.

Figure 3A:
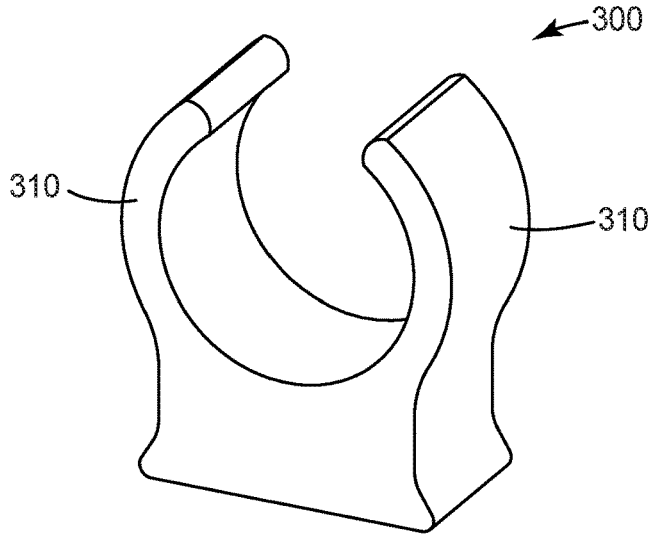
FIG. 3A is a perspective schematic of a clip according to an exemplary embodiment.
Figure 3B:
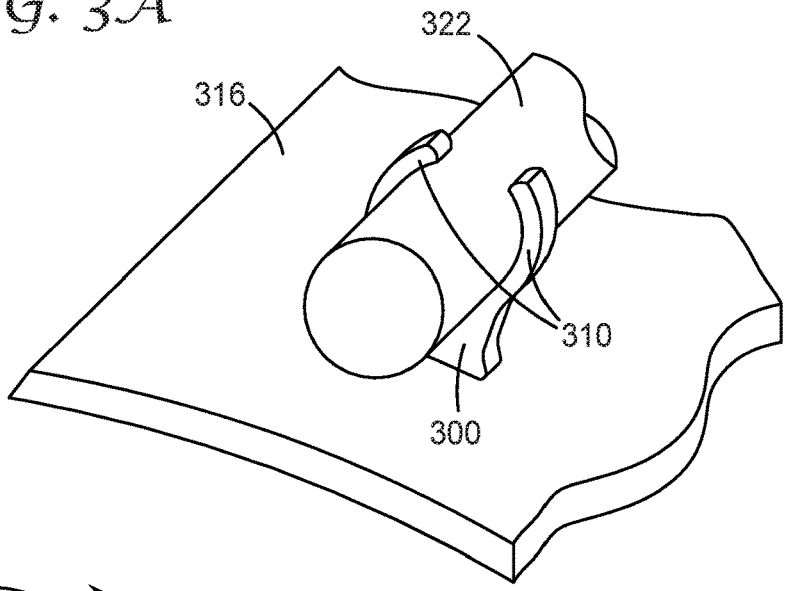
FIG. 3B is a perspective schematic of the clip of FIG. 3A holding a portion of a handle.

Referring to FIG. 3A, a perspective schematic is shown of the at least one fastener comprising a clip 300. The clip 300 is configured to provide a resilient compression fit with a shovel handle, thus the clip 300 is shaped to surround a majority (i.e., greater than 50%) of the circumference of a shovel handle. The clip 300 comprises a pair of opposing ends 310 that have sufficient flexibility to separate from each other at least a distance equal to the circumference of the shovel handle, yet also have sufficient strength to secure the handle within the clip until it is desired to remove the handle. Referring to FIG. 3B, a perspective schematic is shown of a portion of a handle 322 removably secured to a second major surface 316 of a blade by a clip 300. The opposing ends 310 of the clip 300 do not meet but assist in holding the handle 322 in place.

Figure 4:
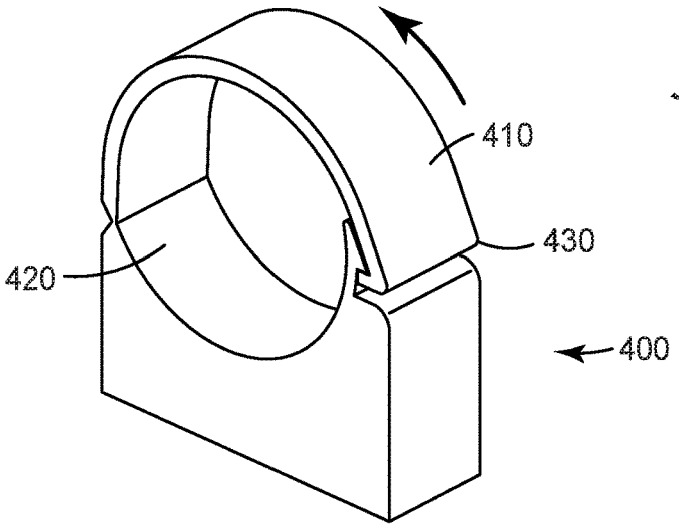
FIG. 4 is a perspective schematic of a clasp according to an exemplary embodiment.

Referring to FIG. 4, in certain embodiments, the at least one fastener comprises a clasp 400. The clasp 400 is configured to provide a fit with a shovel handle and is shaped to surround the entire circumference of a shovel handle. The clasp 400 has a movable portion 410 that lifts back (e.g., via a hinge) to allow the shovel handle to be set on a curved surface 420 and then engages with a compression fit to an end 430 of the curved surface 420 to assist in holding a handle in place. The movable portion 410 can be made of the same material as the rest of the clasp 400, or may be more flexible (e.g., elastomeric) than the remainder of the clasp 400 (e.g., metal, rigid plastic, etc.)

In some embodiments, the fastener(s) are formed of plastic. When the blade is formed of plastic, advantageously the at least one fastener may be integral to the blade. This can be accomplished by designing a mold that includes one or more fasteners such that the blade and fastener(s) are manufactured as a single integral molded piece. Alternatively, the fastener(s) may be made separately from the blade and attached to the second major surface of the blade using screw(s), bolt(s), adhesive, or the like.

The type of connector used to removably attach a shovel handle is selected to provide sufficient connection strength to allow a user to operate the shovel (e.g., move/carry the shovel, push snow, etc.) without the handle undesirably detaching from the blade. For example, in some embodiments, the connector comprises a screw threaded connector, a bolt connector, or a spring-activated pin connector.

Figure 5:
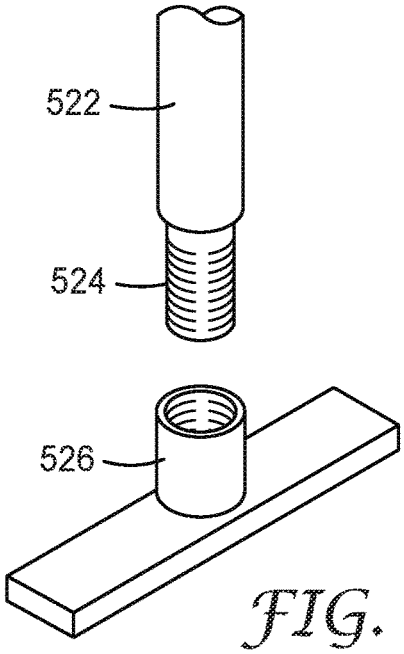
FIG. 5 is a side schematic of a screw threaded connector for a handle.

Referring to FIG. 5, a side schematic is provided of a screw threaded connector 526 and a portion of a handle 522. The screw threaded connector 526 is shown to have female threads and the handle 522 is shown to have male threads 524, but optionally the female and male threads could be reversed between the connector and an end of the handle.

Figure 6:
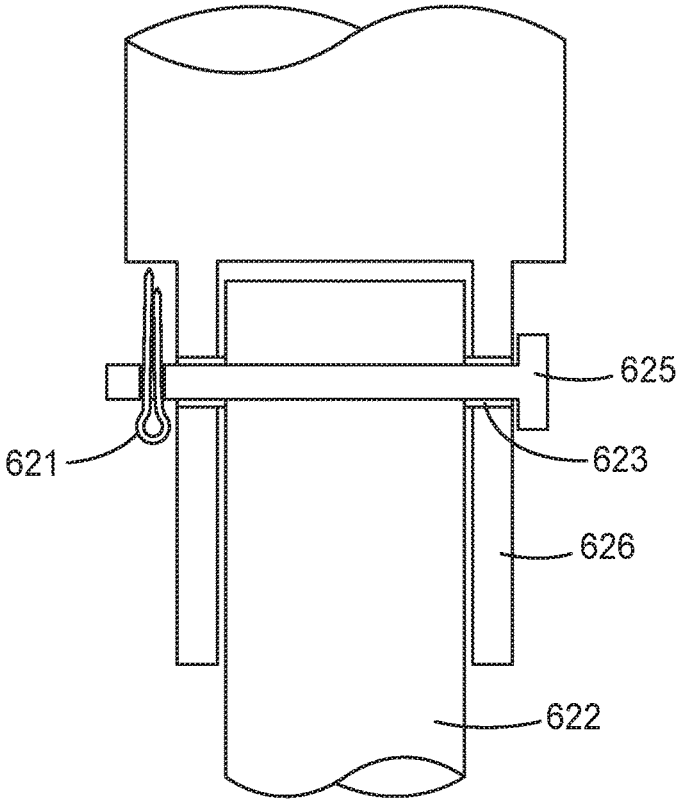
FIG. 6 is a cross-sectional schematic of a bolt connector for a handle.

Referring to FIG. 6, a cross-sectional schematic of a bolt connector 626 linking a handle 622 to the blade (not shown) is provided. Each of the bolt connector 626 and the handle 622 defines an aperture 623 through which a bolt 625 is inserted to connect the handle 622 to the bolt connector 626. A cotter pin 621 is shown to be employed to secure a bolt 625 of the bolt connector 626, however, other common hardware could also be used to secure the bolt 625, such as a screw-threaded nut.

Figure 7A:
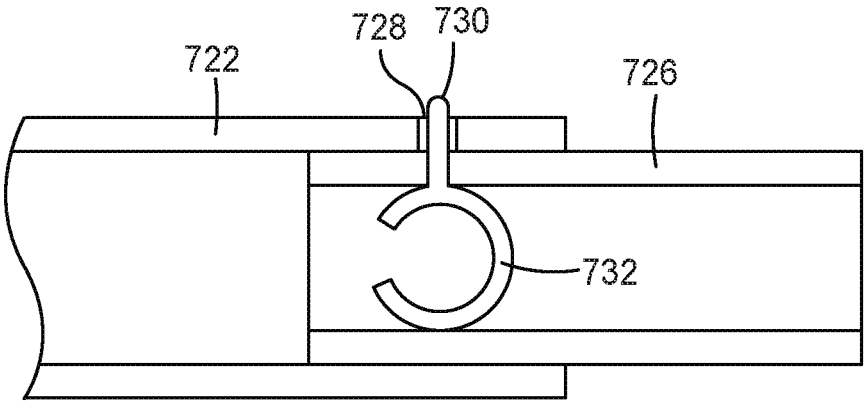
FIG. 7A is cross-sectional schematic of a spring-activated pin connector for a handle.
Figure 7B:
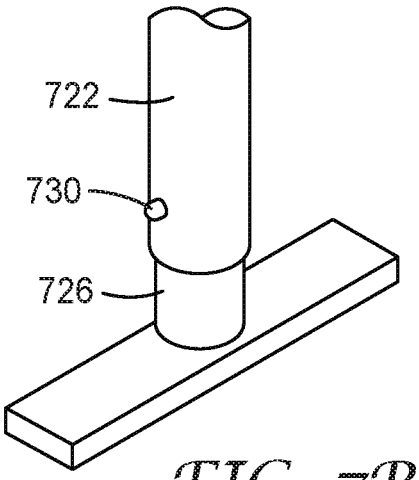
FIG. 7B is a perspective schematic of the spring-activated pin connector of FIG. 7A.

Referring to FIG. 7A, a cross-sectional schematic is provided of a spring-activated pin connector 726. A handle 722 defines an aperture 728 that is configured to allow a spring-activate pin 730 to protrude from the aperture 728 when the handle 722 is inserted into the connector 726 and oriented such that the spring-activated pin 730 is aligned with the aperture 728. The spring-activated pin 730 illustrated in this embodiment comprises a resilient portion 732 that can be compressed when a user presses on an opposing end of the spring-activated pin 730, to allow detachment and/or positioning of the handle 722 and the connector 726 with respect to each other. In alternate embodiments, a coiled spring (not shown) can be employed to urge an end of a pin through an aperture. The handle 722 connected to a blade (not shown) by a spring-activated pin connector 726 is shown in the perspective schematic of FIG. 7B.

Figure 8:
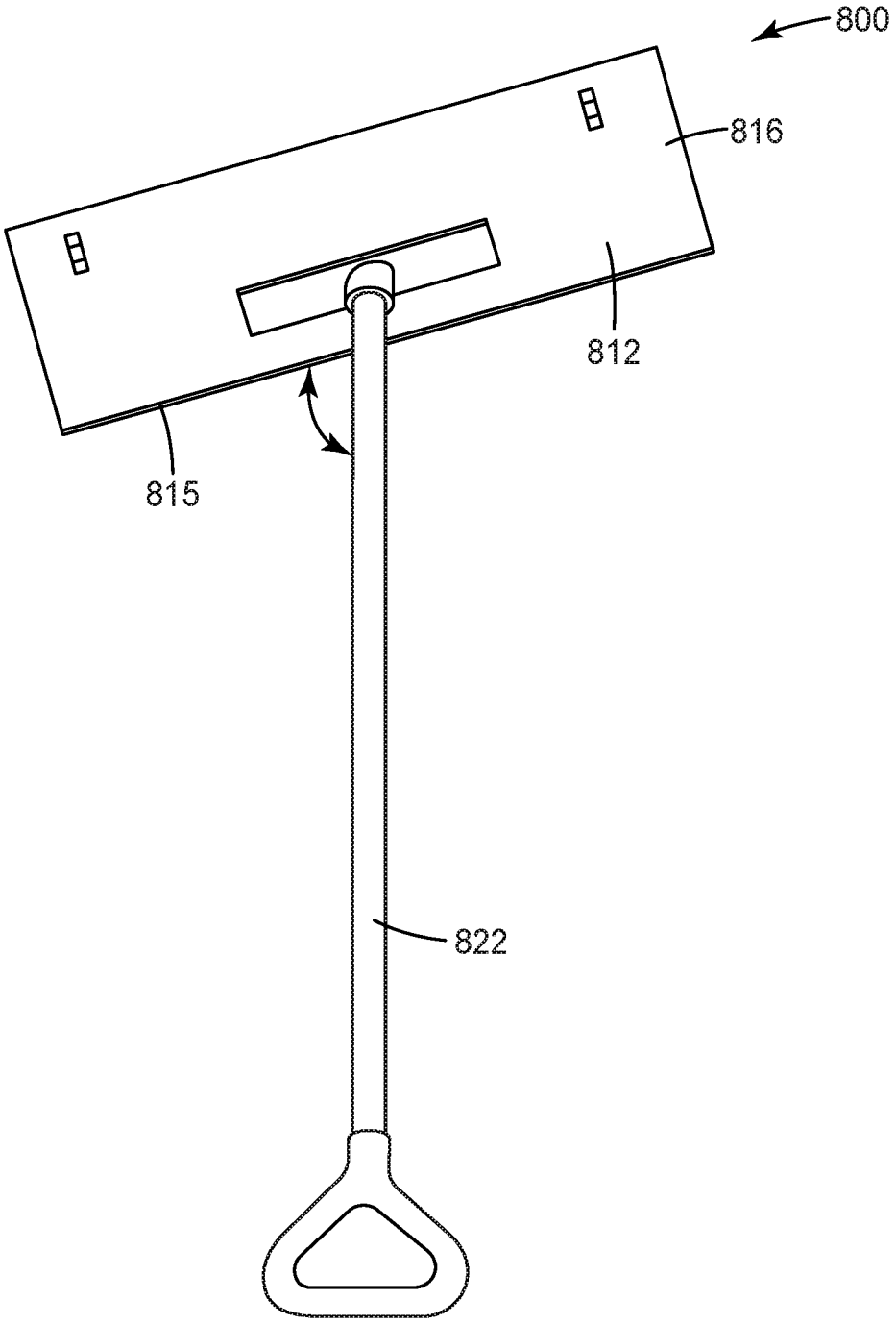
FIG. 8 is a perspective schematic of a shovel according to an exemplary embodiment, in a position for use.

Referring to FIG. 8, in embodiments of a shovel configured for windrowing snow, a schematic perspective is provided of a shovel 800 comprising an angle between a major axis of the handle 822 and the second major surface 816 of the blade 812 of between 30 degrees and 60 degrees, inclusive. For instance, the angle between the major axis of the handle and the second major surface of the blade is 30 degrees or greater, 35 degrees or greater, 40 degrees or greater, or 45 degrees or greater; and 60 degrees or lower, 55 degrees or lower, or 50 degrees or lower. In many embodiments, the second major surface of a blade is curved (e.g., convex). The angle between the major axis of the handle and the second major surface of a curved blade can be considered to be determined from a two-dimensional projection of the handle 822 and a major edge 815 of the blade 812. In the embodiment of FIG. 8, if a user were to walk in a straight line pushing snow, the blade is angled such that snow would get pushed off the side edge of the blade that is closest to the user.

Figure 9A:
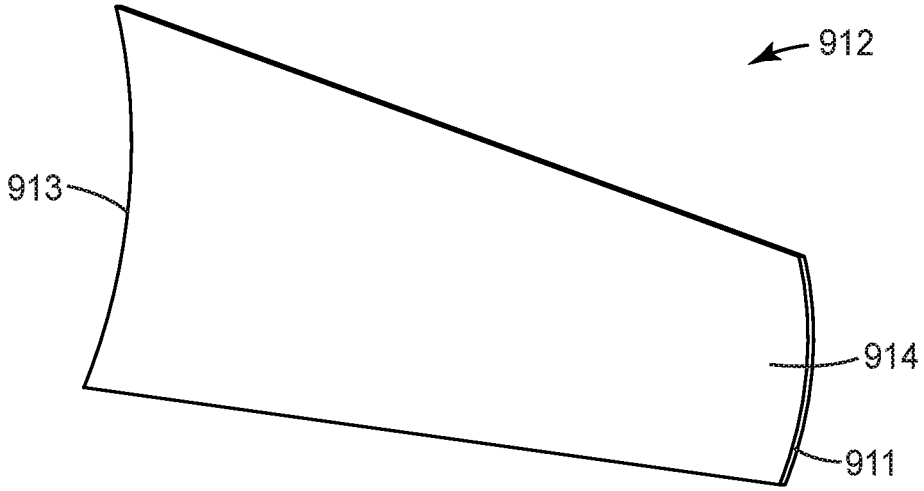
FIG. 9A is a perspective schematic of a blade according to an exemplary embodiment.
Figure 9B:
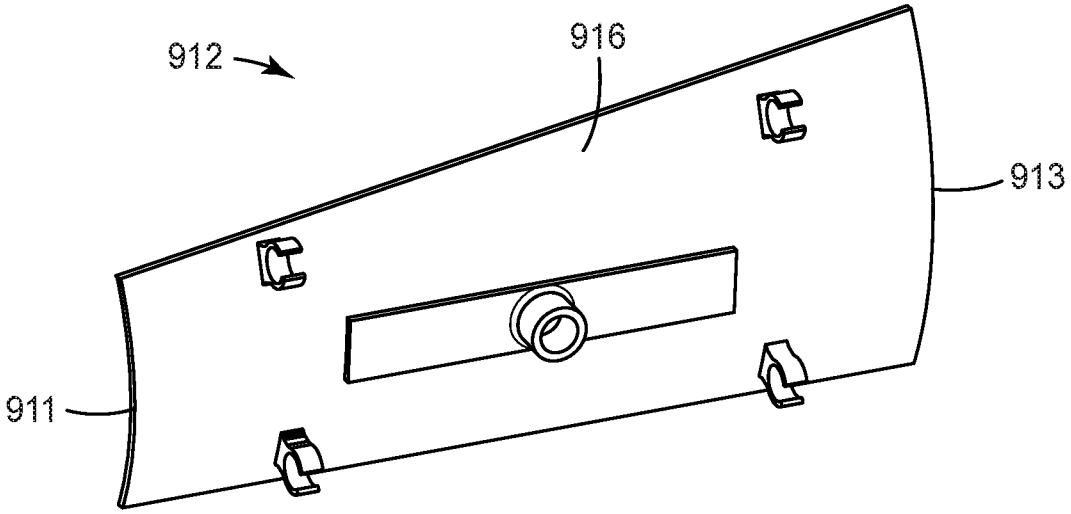
FIG. 9B is a perspective schematic of another blade according to an exemplary embodiment.

Referring to FIGS. 9A and 9B, in most embodiments, the first major surface 914 of the blade 912 comprises a concave curved shape and the second major surface 916 of the blade 912 comprises a convex curved shape. In alternate embodiments, the first major surface and the second major surface of the blade may comprise an essentially flat shape (not shown). Further, in each of the embodiments illustrated in FIGS. 9A and 9B, a blade 912 is provided that comprises two ends, wherein a first end 911 has a smaller length than a second end 913.

The length of the blade is not particularly limited, and may be selected depending on the width of an area to be shoveled. For instance, a narrow sidewalk with grass on either side will require a narrower shovel blade than a driveway so that the length of the blade fits across the width of the sidewalk without impinging on the grass. Typically, a length of the blade is from 14 inches (35.56 centimeters) to 36 inches (91.44 centimeters), inclusive, such as from 24 inches (60.96 centimeters) to 32 inches (81.28 centimeters), inclusive. Stated another way, the length of the blade may be 14 inches or longer, 16 inches or longer, 18 inches or longer, 20 inches or longer, 22 inches or longer, or 24 inches or longer; and 36 inches or shorter, 34 inches or shorter, 32 inches or shorter, 30 inches or shorter, 28 inches or shorter, or 26 inches or shorter.

The material for the handle is not particularly limited. For example, the handle is optionally formed of wood, plastic, fiberglass, metal (e.g., aluminum), or any combination thereof. Suitable plastics include each of the plastic materials mentioned above with respect to the shovel blade. In embodiments including more than one type of material, the handle may be formed of wood or metal while a grip disposed at an end of the handle distal from the blade comprises plastic, for instance.

An advantage of embodiments according to the present disclosure is that the shovel is adaptable for both use in shoveling and for storage or transport with a smaller tool footprint (e.g., in a small vehicle trunk or on a shelf).

Various non-limiting exemplary embodiments according to the present disclosure are provided below.

Exemplary Embodiments

Embodiment 1 is a shovel. The shovel comprises a) a blade comprising a first major surface and an opposing second major surface of the blade; b) at least one fastener attached to the second major surface; c) a connector attached to the second major surface of the blade; and d) a handle removably attached to the connector.

Embodiment 2 is the shovel of embodiment 1, wherein the at least one fastener is configured to removably receive and hold the handle.

Embodiment 3 is the shovel of embodiment 1 or embodiment 2, wherein the at least one fastener is integral to the blade.

Embodiment 4 is the shovel of any of embodiments 1 to 3, wherein the at least one fastener comprises two to four fasteners.

Embodiment 5 is the shovel of any of embodiments 1 to 4, wherein the at least one fastener comprises a clip.

Embodiment 6 is the shovel of any of embodiments 1 to 5, wherein the at least one fastener comprises a clasp.

Embodiment 7 is the shovel of any of embodiments 1 to 6, wherein an angle between a major axis of the handle and the second major surface of the blade is between 30 degrees and 60 degrees, inclusive.

Embodiment 8 is the shovel of any of embodiments 1 to 7, wherein an angle between the major axis of the handle and the second major surface of the blade is about 45 degrees.

Embodiment 9 is the shovel of any of embodiments 1 to 8, wherein the blade is formed of plastic.

Embodiment 10 is the shovel of any of embodiments 1 to 9, wherein the at least one fastener is formed of plastic.

Embodiment 11 is the shovel of any of embodiments 1 to 10, wherein the connector comprises a screw threaded connector.

Embodiment 12 is the shovel of any of embodiments 1 to 10, wherein the connector comprises a bolt connector.

Embodiment 13 is the shovel of any of embodiments 1 to 10, wherein the connector comprises a spring-activated pin connector.

Embodiment 14 is the shovel of any of embodiments 1 to 13, wherein the handle comprises two detachable pieces.

Embodiment 15 is the shovel of any of embodiments 1 to 14, wherein the blade comprises two ends, wherein a first end has a smaller length than a second end.

Embodiment 16 is the shovel of any of embodiments 1 to 15, wherein the first major surface of the blade comprises a concave curved shape and the second major surface of the blade comprises a convex curved shape.

Embodiment 17 is the shovel of any of embodiments 1 to 16, wherein a length of the blade is from 14 inches (35.56 centimeters) to 36 inches (91.44 centimeters), inclusive.

Embodiment 18 is the shovel of any of embodiments 1 to 17, wherein the length of the blade is from 24 inches (60.96 centimeters) to 32 inches (81.28 centimeters), inclusive.

Embodiment 19 is the shovel of any of embodiments 1 to 18, wherein the handle is formed of wood, plastic, fiberglass, metal, or a combination thereof.

While the specification has described in detail certain exemplary embodiments, it will be appreciated that those skilled in the art, upon attaining an understanding of the foregoing, may readily conceive of alterations to, variations of, and equivalents to these embodiments. Furthermore, all publications and patents referenced herein are incorporated by reference in their entirety to the same extent as if each individual publication or patent was specifically and individually indicated to be incorporated by reference. Various exemplary embodiments have been described. These and other embodiments are within the scope of the following claims.

What is claimed is:

1. A shovel comprising:

a) a blade comprising a first major surface and an opposing second major surface;

b) at least one fastener attached to the second major surface of the blade;

c) a connector attached to the second major surface of the blade; and d) a handle removably attached to the connector, wherein the at least one fastener is configured to removably receive and hold the handle, wherein the at least one faster comprises a clasp, and wherein the clasp comprises a curved surface and a movable portion configured to move via a hinge, wherein, when the movable portion of the clasp is in a closed position, the movable portion and the curved surface provide a compression fit around at least a majority of the handle.

2. The shovel of claim 1, wherein the at least one fastener is integral to the blade.

3. The shovel of claim 1, wherein the at least one fastener comprises two to four fasteners.

4. The shovel of claim 1, wherein an angle between a major axis of the handle and the second major surface of the blade is between 30 degrees and 60 degrees, inclusive.

5. The shovel of claim 4, wherein the angle between the major axis of the handle and the second major surface of the blade is about 45 degrees.

6. The shovel of claim 1, wherein the blade is formed of plastic.

7. The shovel of claim 1, wherein the at least one fastener is formed of plastic.

8. The shovel of claim 1, wherein the connector comprises a screw threaded connector.

9. The shovel of claim 1, wherein the connector comprises a bolt connector.

10. The shovel of claim 1, wherein the connector comprises a spring-activated pin connector.

11. The shovel of claim 1, wherein the handle comprises two detachable pieces.

12. The shovel of claim 1, wherein the blade comprises two ends, wherein a first end has a smaller length than a second end.

13. The shovel of claim 1, wherein the first major surface of the blade comprises a concave curved shape and the second major surface of the blade comprises a convex curved shape.

14. The shovel of claim 1, wherein a length of the blade is from 14 inches to 36 inches, inclusive.

15. The shovel of claim 14, wherein the length of the blade is from 24 inches to 32 inches, inclusive.

16. The shovel of claim 1, wherein the handle is formed of wood, plastic, fiberglass, metal, or a combination thereof.

* * * * *